US006416155B1

(12) United States Patent
Takahashi et al.

(10) Patent No.: US 6,416,155 B1
(45) Date of Patent: Jul. 9, 2002

(54) INK JET RECORDING HEAD, INK JET RECORDING CARTRIDGE, AND RECORDING APPARATUS

(75) Inventors: Wataru Takahashi, Kawasaki; Masanori Takenouchi, Yokohama; Ken Hosaka, Yokohama; Shin Ishimatsu, Yokohama; Shigeki Fukui, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/426,897

(22) Filed: Oct. 26, 1999

(30) Foreign Application Priority Data

Oct. 27, 1998 (JP) ..... 10-306142

(51) Int. Cl.[7] ..... B41J 2/015; B41J 2/05
(52) U.S. Cl. ..... 347/20; 347/65
(58) Field of Search ..... 347/20, 44, 40, 347/65, 84–87, 49, 66, 67

(56) References Cited

U.S. PATENT DOCUMENTS 5,025,271 A * 6/1991 Baker et al. ..... 347/86
5,389,957 A * 2/1995 Kimura et al. ..... 347/20
6,113,223 A 9/2000 Tanaka et al. ..... 347/65
6,170,940 B1 * 1/2001 Shinada et al. ..... 347/86

FOREIGN PATENT DOCUMENTS

| | | | |
|---|---|---|---|
| EP | 0 419 180 | 3/1991 | ..... B41J/2/05 |
| EP | 0 440 263 | 8/1991 | ..... B41J/2/16 |
| EP | 0 602 021 | 6/1994 | ..... B41J/2/16 |
| EP | 0 819 536 | 1/1998 | ..... B41J/2/14 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet recording head comprising an element base having a plurality of energy generating elements for generating energy used for discharging ink, a grooved top plate having a plurality of grooves corresponding to the plurality of energy generating elements, being joined to the element base, and having a plurality of ink flow channels formed by the plurality of grooves on a joint area side to the element base, an orifice plate having a plurality of orifices having communication with the plurality of ink flow channels respectively and being mounted on the grooved top plate integrally, and a chip tank having supply passages for supplying ink to the plurality of ink flow channels.

22 Claims, 16 Drawing Sheets

INK JET RECORDING HEAD, INK JET RECORDING CARTRIDGE, AND RECORDING APPARATUS

BACKGROUND OF THE INVENTION

1. Field of the Invention

The present invention relates to an ink jet recording head, an ink jet recording cartridge having an ink jet recording head and a recording apparatus.

The present invention is applicable to a printer, a copying machine, a facsimile having a communication system, an apparatus having a printer unit such as a word processor, and further an industrial recording apparatus combined with various processors in a complex constitution for recording into a record medium such as paper, thread, fiber, fabric, leather, metal, plastic, glass, wood, ceramics, or the like. "Record" in this invention means not only giving an image having a meaning of characters or graphics to the record medium, but giving an image having no meaning such as a pattern.

2. Related Background Art

In various types of electronic equipment such as a computer, a word processor, a facsimile device, and a copying machine, an ink jet recording head which enables high-speed recording is widely used as a means for recording into record mediums without generating noises like ones generated by a dot impact printer.

Referring to FIG. 23, there is shown a schematic perspective view outlining a main portion of a conventional ink jet recording head. Referring to FIG. 24, there is shown its expanded sectional view.

As shown in FIGS. 23 and 24, an element base 112 having energy generating elements 102 (See FIG. 24) for generating energy used for discharging ink is joined to a grooved top plate 113 having grooves forming ink flow channels 105, a wall portion 106 to be an ink flow channel wall, and a hollow 107' to be a common liquid chamber 107 for supplying ink to the ink flow channels 105. The grooved top plate 113 includes an orifice plate 104 having a plurality of orifices 101 for communication with the ink flow channels 105, with being integrally formed. The element base 112 is fixed to a base plate 111, and further the element base 112 is mechanically contact-bonded to the grooved top plate 113 with a spring force of a pushing member 114.

In recent years, a high-quality and high-density recording is required for this type of the ink jet recording head and it has brought with it a requirement of the orifices 101 having fine and accurate shapes. Accordingly, the orifices 101 are generally formed by laser processing suitable for fine processing. On the characteristics of the orifices, it is desirable that the orifices 101 have shapes converging in a direction from the side of the ink flow channels 105 to the outside, and therefore the orifices are irradiated for the processing with laser light in a direction from the side of the ink flow channels 105 to the orifice plate 104.

As shown in FIG. 24, if the orifice plate 104 is perpendicularly irradiated with laser light (indicated by a long and two short dashes line 116), the laser light is inevitably applied to a wall portion 113*a* of the grooved top plate 113, by which the applied portion is scraped. This makes a hole from which ink leaks into the ink flow channels 105, by which the ink cannot be discharged. Accordingly, laser light is applied diagonally (indicated by a long and two short dashes line 115) so as to avoid the wall portion 113*a* when making the orifices 101 diagonally to the orifice plate (Angle of inclination: Approx. 70 to 83 deg). If ink is discharged diagonally to a record medium 103 in recording, however, the discharge direction becomes unstable or dot shapes formed on the record medium tend to be uniformless and enlarged, in other words, the recording quality is deteriorated. Particularly in color printing, a dotted point depends upon each color, by which color-shading or satellite significantly deteriorates an image in some cases in multipath printing at cockling of a record medium or in reciprocating printing.

Therefore, there is suggested a constitution for improving a recording quality by attaching an ink jet recording head to a recording apparatus in an inclined position so that ink is discharged perpendicularly to the record medium in a Japanese Patent Laid-Open Application No. 4-211954.

While the invention in the Japanese Patent Laid-Open Application No. 4-211954 was a practically effective, new problems were found in such a case that a large cockling (a wrinkle or an undulation) may be caused by an absorption of ink on a record medium, particularly a recording sheet or that a mist may adhere to the orifice plate and accumulated.

If the entire ink jet recording head is inclined, the orifice plate is not put in a parallel state with the record medium, but necessarily put in a slightly inclined (approx. 7 to 20 deg) state. Therefore, a large cockling of the record medium causes the record medium to be partially put in contact with the orifice plate since they are too close to each other, by which the recording quality may be partially degraded.

The mist adhering to and accumulated on the orifice plate is generally retained on the orifice plate under an adhering state without affecting the record medium. If the orifice plate is inclined as described above, however, the mist easily moves to one direction being affected by an inertia force caused by a reciprocating motion of the ink jet recording head, and therefore there is a possibility of the mist separating from the orifice plate to adhere to the record medium or the recording apparatus or other components. Particularly the possibility is significant if the adhering mist is accumulated to a large amount or if the ink jet recording head reciprocates at a high speed in high-speed recording.

SUMMARY OF THE INVENTION

Therefore it is an object of the present invention to provide an ink jet recording head and an ink jet recording cartridge which enable high-quality recording without being so much affected by cockling of a record medium nor high-speed motion and further to provide a recording apparatus having these ink jet recording head and the ink jet recording cartridge.

It is another object of the present invention to provide an ink jet recording head comprising an element base having a plurality of energy generating elements for generating energy used for discharging ink, a grooved top plate having a plurality of grooves corresponding to the plurality of energy generating elements, being joined to the element base, and having a plurality of ink flow channels formed by the plurality of grooves on a joint area side to the element base, an orifice plate having a plurality of orifices having communication with the plurality of ink flow channels respectively and being mounted on the grooved top plate integrally, and a chip tank having supply passages for supplying ink to the plurality of ink flow channels and having a shroud portion for shrouding the orifice plate, wherein a surface in the side of the plurality of orifices of the orifice plate is substantially parallel with the shroud portion of the chip tank and is inclined relative to the element base.

It is still another object of the present invention to provide an ink jet recording head comprising an element base having a plurality of energy generating elements for generating energy used for discharging ink, a grooved top plate having a plurality of grooves corresponding to the plurality of energy generating elements, being joined to the element base, and having a plurality of ink flow channels formed by the plurality of grooves on a joint area side to the element base, and an orifice plate having a plurality of orifices having communication with the plurality of ink flow channels respectively, having a recess surface formed on the area in which the plurality of orifices are arranged, and being mounted on the grooved top plate integrally, wherein an area closest to the plurality of orifices among surfaces in the side of the plurality of orifices of the orifice plate is substantially parallel with peripheral areas of the recess surface of the orifice plate and is inclined to the element base.

It is a further object of the present invention to provide an ink jet recording cartridge comprising an ink jet recording head unit including an element base having a plurality of energy generating elements for generating energy used for discharging ink, a base plate for fixing the element base and, a grooved top plate having a plurality of grooves corresponding to the plurality of energy generating elements respectively, being joined to the element base, and having a plurality of ink flow channels formed by the plurality of grooves on a joint area side to the element base, and a head unit retaining member including an engaging groove portion where the ink jet recording head unit can be retained with the base plate inserted and a guide portion for guiding the ink jet recording head unit to the engaging groove portion by sliding the base plate.

It is a still further object of the present invention to provide an ink jet recording cartridge comprising an ink jet recording head unit for discharging ink, a head unit retaining member for retaining the ink jet recording head unit, and an ink tank retaining member for retaining an ink tank for containing ink, wherein the ink jet recording head unit is provided with an inlet to which ink is supplied, the ink tank retaining member is provided with an outlet tube for flowing out the ink connected to the ink tank, and the inlet is connected to the outlet tube so as to enable the ink to flow, and wherein the head unit retaining member is connected to the ink tank retaining member.

It is another object of the present invention to provide a recording apparatus comprising an ink jet recording head or an ink jet recording cartridge having the above constitution and a record medium conveying means for conveying a record medium arranged substantially perpendicularly to a discharge direction of ink discharged from the ink jet recording head or the ink jet recording cartridge.

In the present invention, the orifice plate is inclined to the element base, by which it can be arranged in parallel with the record medium surface and ink can be discharged perpendicularly to the record medium. Therefore, high-quality recording is achieved without being so much affected by cockling of a record medium or a high-speed motion.

Furthermore in a constitution in which a guide portion is arranged continuously from a head unit positioning reference surface of an engaging groove portion of a head unit retaining member, a head unit can be easily attached with a high positioning precision by sliding a base plate to an engaging groove portion along a guide portion continuously arranged from a head unit positioning reference surface when the head unit is attached to a head unit retaining member.

Furthermore, in a constitution in which an ink tank is attached to a head unit retaining member through an ink tank retaining member, a shock or vibrations generated at an attachment or detachment of the ink tanks can be relieved by the ink tank retaining member or a head unit fixing member, by which the shock or vibrations can be reduced before they are transmitted to the head unit.

DETAILED DESCRIPTION OF THE PREFERRED EMBODIMENTS

An embodiment of the present invention will be described below with reference to accompanying drawings.

An ink jet recording head of this embodiment is described first. As described later, this ink jet recording head is of an integrated unit type assembled with a plurality of components, and therefore it is referred to as an ink jet recording head unit or simply as a head unit. In addition, a term "incline" in this specification means a state of not being perpendicular nor parallel to a criterion.

Figure 1:
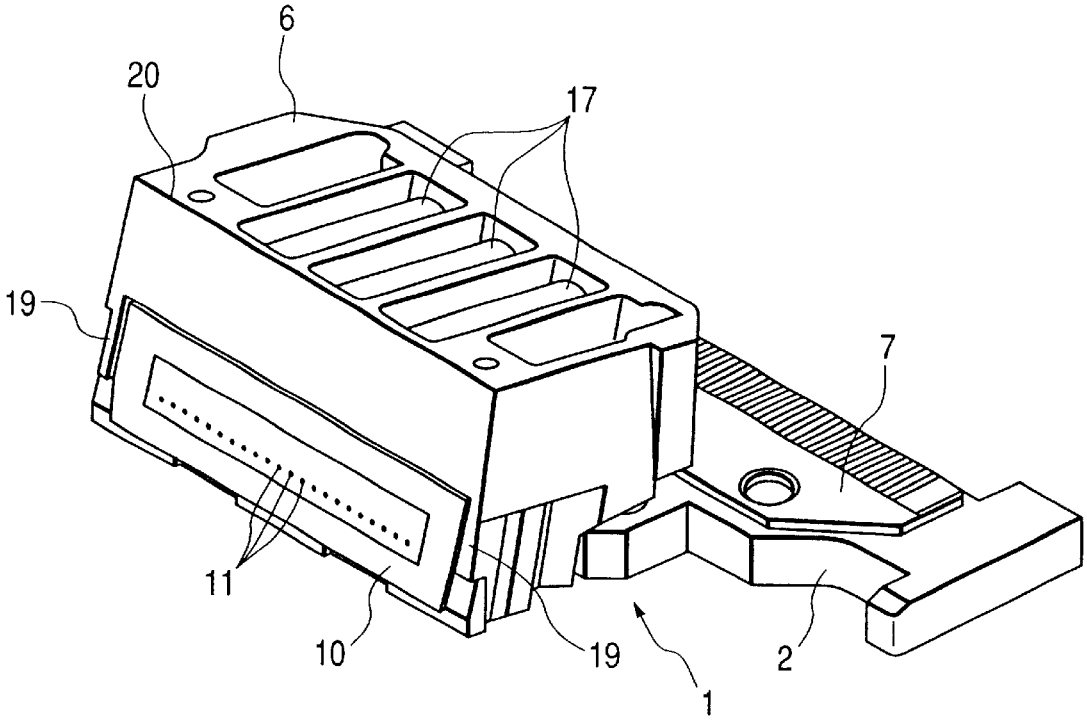
FIG. 1 is a main portion perspective view of a head unit according to an embodiment of the present invention.
Figure 17:
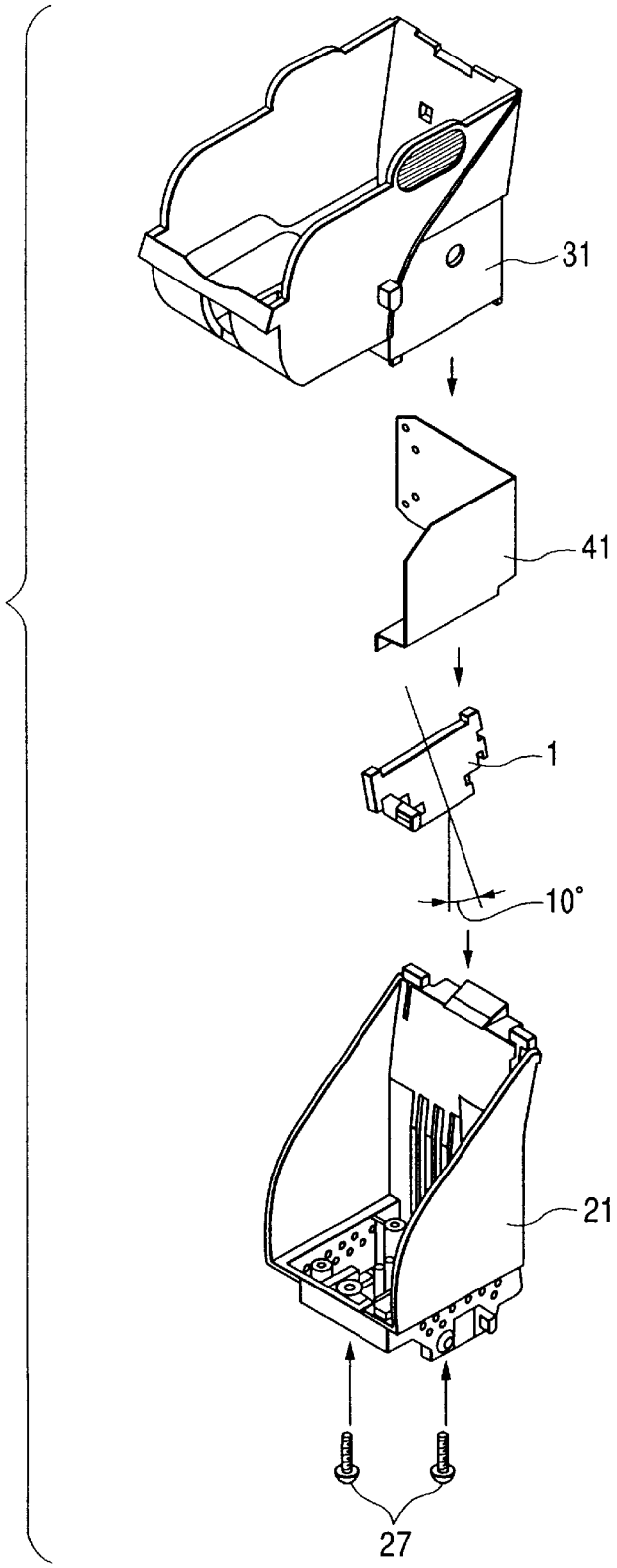
FIG. 17 is an explanatory perspective view showing a method of connecting the head unit retaining member with the ink tank retaining member according to the embodiment of the present invention.

An entire constitution of a head unit 1 shown in FIG. 1 is generally described. An element base 3 (See FIGS. 2 to 4) is laid on a base plate 2 and a grooved top plate 4 is joined to the top thereof with being contact-bonded by a pushing member 5. Furthermore, a chip tank 6 for an ink supply is arranged above it with being fixed to the base plate 2. At the rear of the base plate 6, a wiring base 7 to which a flexible cable 41 (See FIG. 17) is connected is fixedly secured.

Figure 2:
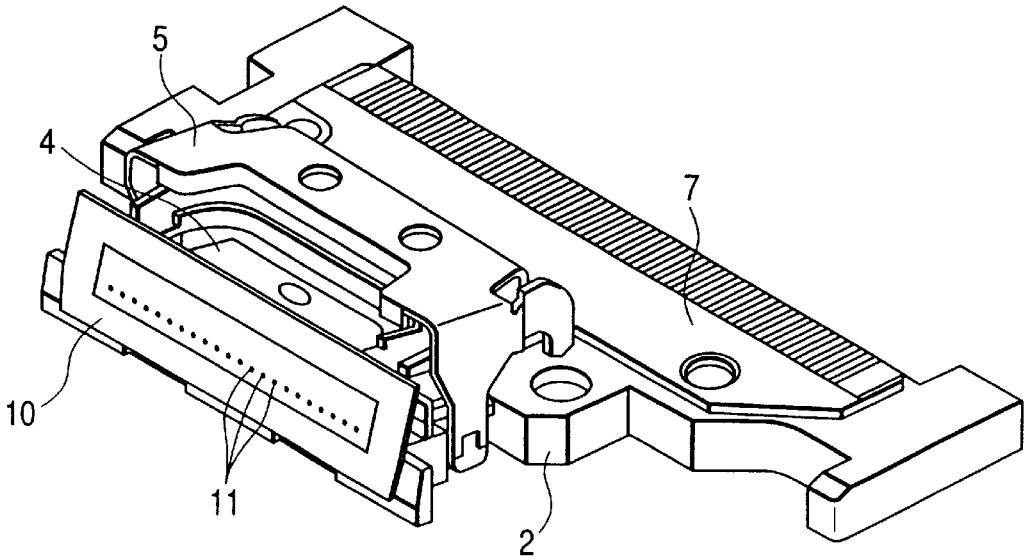
FIG. 2 is a perspective view of the head unit without the chip tank shown in FIG. 1.
Figure 3:
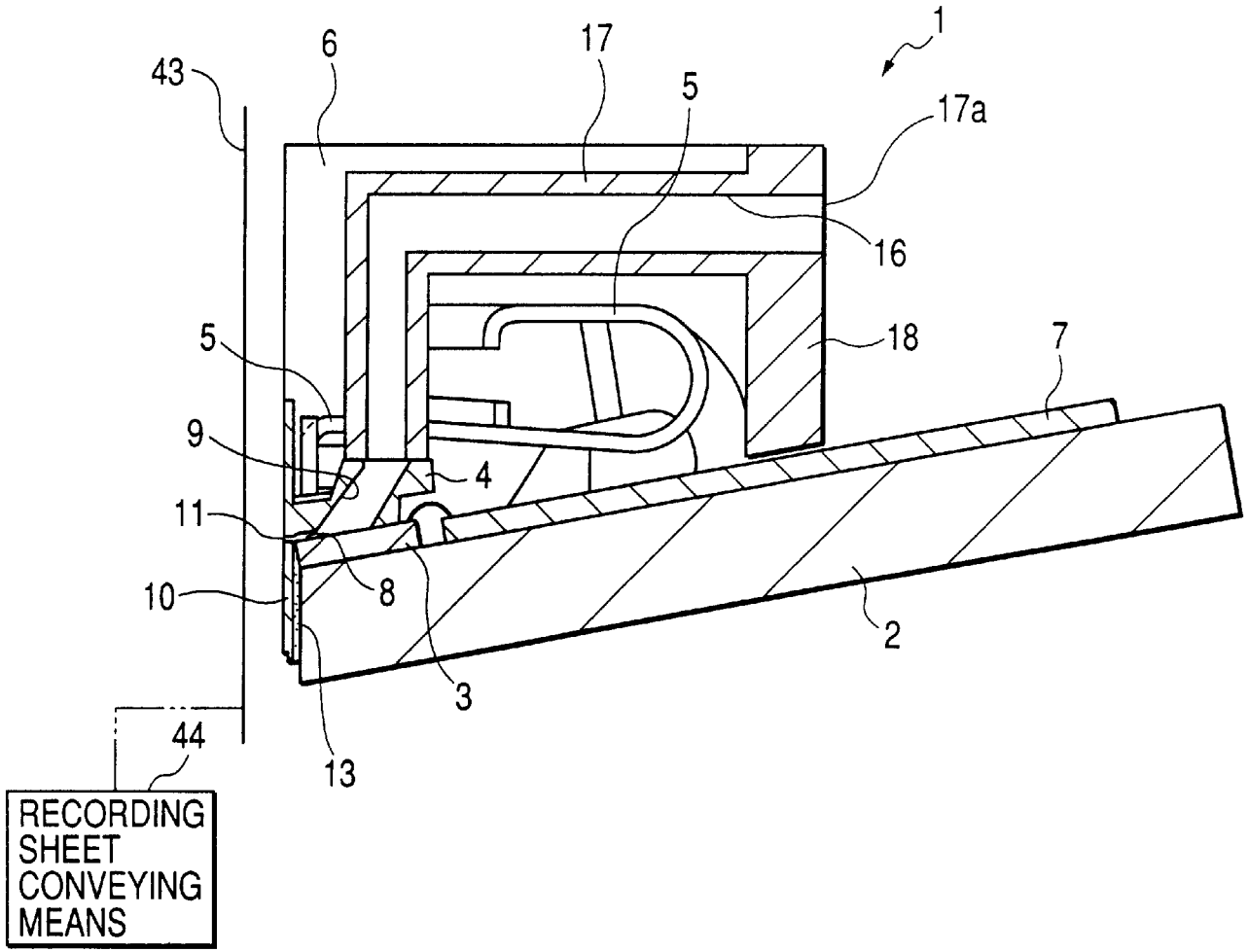
FIG. 3 is a main portion sectional view of a recording apparatus including the head unit shown in FIG. 1.
Figure 4:
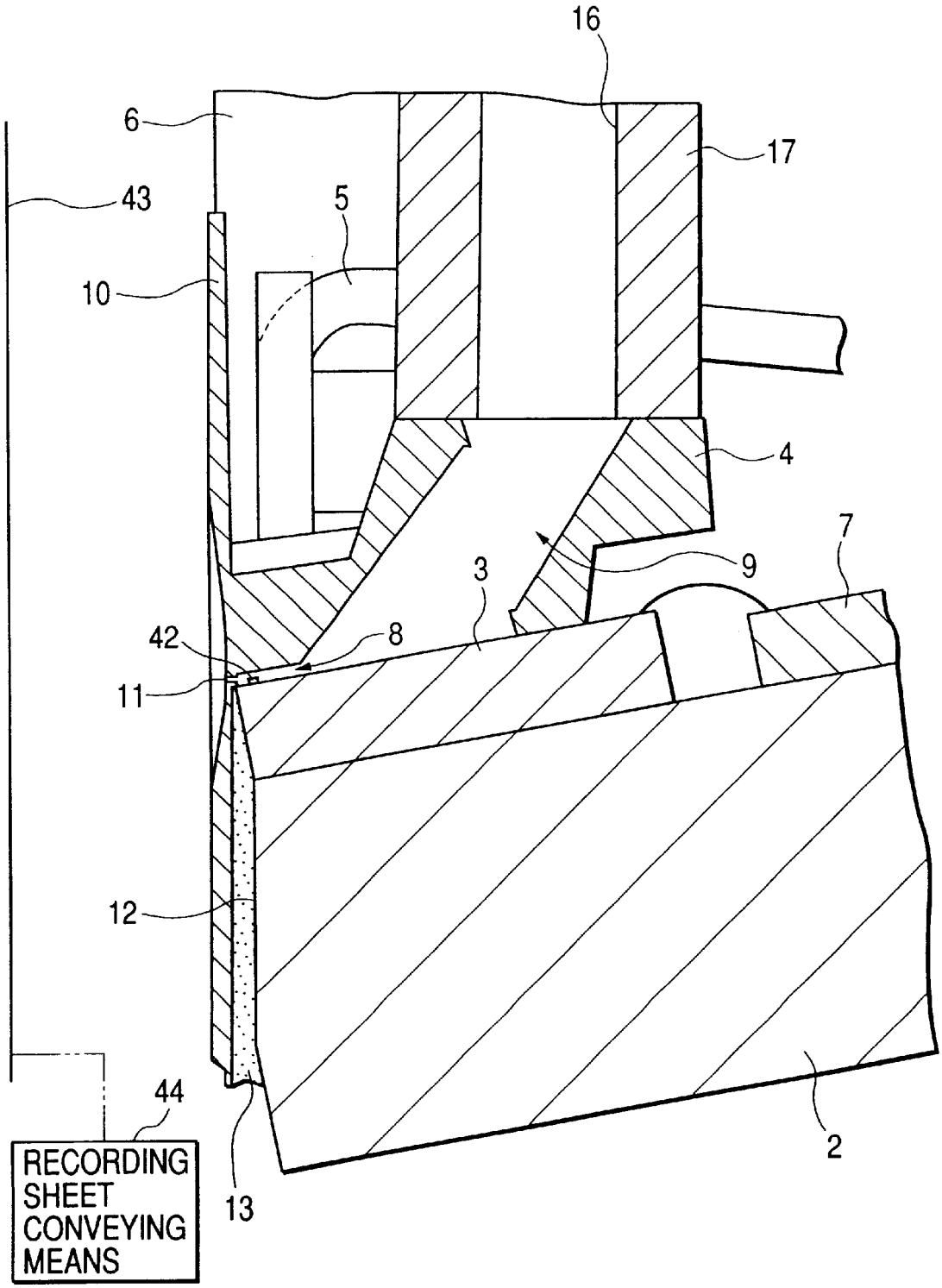
FIG. 4 is a partially expanded view of the recording apparatus shown in FIG. 3.

FIG. 2, FIG. 3, and FIG. 4 show a condition that the chip tank 6 is detached from the head unit in FIG. 1, a schematic sectional view of a recording apparatus including the head unit 1, and a partially expanded view of the recording apparatus in FIG. 3, respectively. FIG. 5, FIG. 6, FIG. 7, and FIG. 8 show a sectional view of a grooved top plate 4 having an orifice plate 10, a top plan view of the head unit shown in FIG. 1, a rear perspective view of the grooved top plate 4, and a perspective view of the base plate 2, respectively. Referring to FIGS. 2 to 6, the constitution of the head unit 1 is described further in detail below. The element base 3 has one side (the lower side in FIGS. 2 and 3) on the base plate 2 and the other side (the upper side in FIGS. 2 and 3) on which there are arranged a plurality of energy generating elements 42 (See FIG. 4). The energy generating elements 42 in this embodiment are electrical heat converting elements. The grooved top plate 4 has grooves 8' (See FIG. 5) forming ink flow channels 8 in a positional relationship in which they can be opposite to the plurality of energy generating elements 42, respectively (See FIG. 5) and a hollow 9' (See FIG. 5) forming a common liquid chamber 9 which has communication with these grooves. By joining an element arrangement area of the element base 3 to a groove formation area of the grooved top plate 4, a plurality of ink flow channels 8 are formed in this joint area. Furthermore, the orifice plate 10 is integrated with the grooved top plate 4. On the orifice plate 10, there are arranged a plurality of fine orifices 11 having communication with the ink flow channels 8. In the same manner as for the conventional head unit, these orifices are inclined at approx. 10 deg to a direction of a flow of the ink flow channels 8. All of the base plate 2, the element base 3, and the ink flow channels 8 are arranged substantially in parallel with each other. The orifice plate 10 is inclined at approx. 80 deg to the base plate 2, the element base 3, and the ink flow channels 8 and positioned substantially perpendicularly to the orifices 11.

As shown in FIG. 4, an inclined portion 12 having substantially the same angle of inclination as for the orifice plate 10 is formed on a surface of the base plate 2 opposite to the orifice plate 10. In addition, in a gap formed by the element base 3, the base plate 2, and the orifice plate 10, there is arranged a silicone layer 13 for protecting the orifice plate 10. This silicone layer 13 has been made by injecting a silicone material toward the rear of the orifice plate 10 from silicone material injection aperture 14 (See FIG. 6) arranged on the both sides of the grooved top plate 4 and setting it. Before injecting the silicone material, it is preferable to incline this head unit 1. In addition, an air in the gap formed by the element base 3, the base plate 2, and the orifice plate 10 is let escape from a slit 15 (See FIG. 8) arranged on the base plate 2, and therefore no bubbles are included when the silicone layer 13 is formed. The base plate 2 is fixed to the element base 3 by means of conductive adhesive in a positional relationship in which the orifice plate 10 is spaced about 0.1 mm away from the base plate 2.

Figure 7:
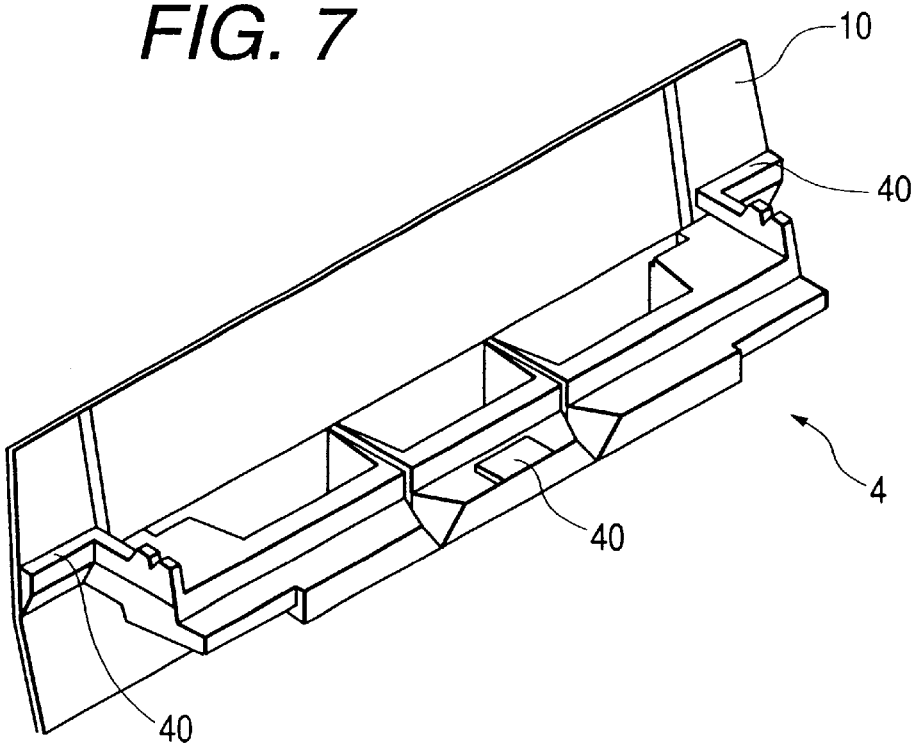
FIG. 7 is a rear perspective view of the grooved top plate of the head unit shown in FIG. 1.
Figure 8:
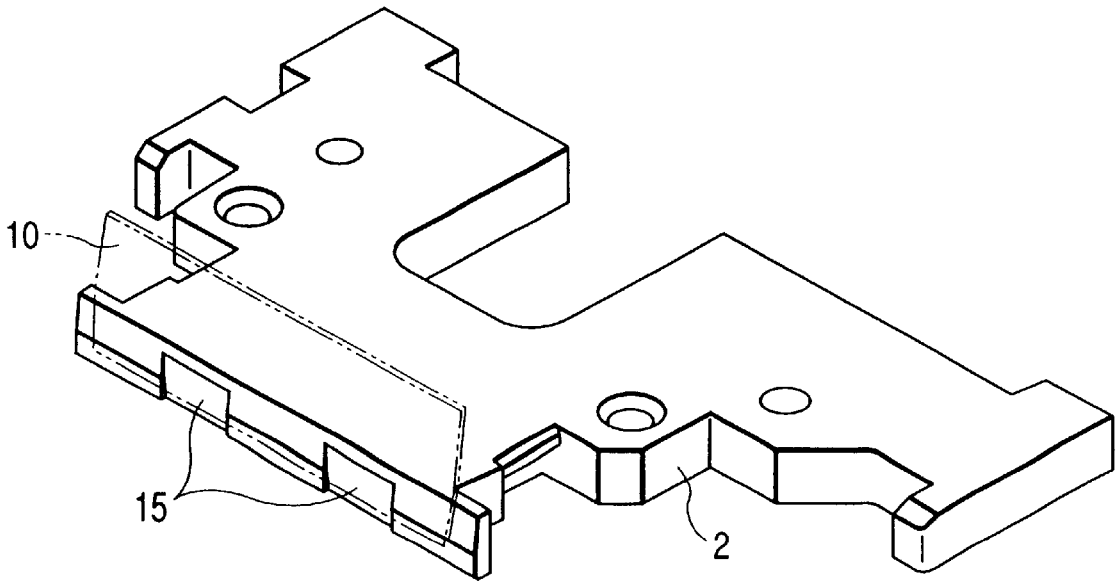
FIG. 8 is a perspective view of a base plate of the head unit shown in FIG. 1.

As shown in FIG. 7, a processing reference surface 40 is formed on the grooved top plate 4. This processing reference surface 40 is used as a surface for fixing a jig for a laser irradiation for a formation of the orifices 11 of the grooved top plate 4, though it is not shown. In this constitution, an irradiation angle of laser rays at processing becomes more accurate by forming the grooved top plate 4 precisely, which leads to obtaining a more precise angle of the orifices 11, in other words, a more precise ink discharge angle. In a bi-directional recording, a reciprocation density difference is generated due to a satellite at recording, while the reciprocation density difference can be reduced by adjusting a discharge angle by approx. ±2 deg, for example (more preferably, approx. ±1 deg). In this embodiment, the precision of controlling the discharge angle for reducing the reciprocation density difference as described above can be improved by arranging the processing reference surface 40 on the grooved top plate 4.

In the chip tank 6, there is arranged inlet tubes 17 each having a supply passage 16 having communication with the common liquid chambers 9. In this embodiment, three common liquid chambers 9 are formed on the assumption that color printing with three color inks is performed, and therefore three supply passages 16 and three inlet tubes 17 are arranged. End portions in the outside of the three inlet tubes 17 (end portions in the side opposite to the end portions in contact with the grooved top plate 4) are connected to a plane portion 18 forming an outer wall of the chip tank 6. In other words, inlets 17*a* are located in this plane portion 18.

In the chip tank 6, the inlet tubes 17 are formed perpendicularly to a surface of a recording sheet 43 in the vicinity of the inlets 17*a* so as to obtain the inlets 17*a* of the chip tank 6 each having a circular form and so that a surface on which the inlets 17*a* are located is parallel to the surface of the recording sheet 43 (See FIG. 3) which is a record medium. The circular inlets 17*a* stabilizes the ink inflow and the arrangement of the surface where the inlets 17*a* are located in parallel to the surface of the recording sheet makes it possible to achieve a connection with other components safely and simply by a force applied perpendicularly to the surface of the recording sheet. As a result, each of the inlet tubes 17 in the chip tank is L-shaped. In addition, the inlet tubes 17 are connected with the grooved top plate 4 by filling a circumferential space with a silicone material and setting it in a state that the inlets 17*a* are contacted to the grooved top plate with pressure. In order to put the inlets 17*a* in contact with the grooved top plate 4 with pressure, the inlet tubes 17 have elasticity. The recording sheet (record medium) 43 is arranged substantially in parallel with the orifice plate 10 and substantially perpendicularly to the orifices 11, and then it is conveyed to a recording sheet conveying means (record medium conveying means) 44.

The recording sheet conveying means 44 is not described here in detail, except that it includes a conveying roller or the like which is not shown.

In the chip tank 6, a shroud portion 19 is arranged so that the orifice plate is shrouded and the shroud portion 19 protects the orifice plate 10 from a frictional force generated by a wiper of the recording apparatus which is not shown or an external force from a side portion. The shroud portion 19 is put substantially in parallel with the orifice plate 10, in other words, inclined at about 80 deg to the element base 3. This puts the shroud portion 19 in parallel with the recording sheet 43, by which a distance between them is reduced.

A surface of the chip tank 6 (the top of the chip tank in FIG. 1) is formed substantially perpendicularly to the orifice plate 10 and the surface of the recording sheet, in other words, inclined at approx. 10 deg to the base plate 2, the element base 3, and the ink flow channels 8. This secures a containing space for the inlet tubes 17 in the chip tank 6. On the top of the chip tank 6, there is arranged an edge portion 20 for scraping highly mucilaginous ink adhering to the wiper.

Figure 5:
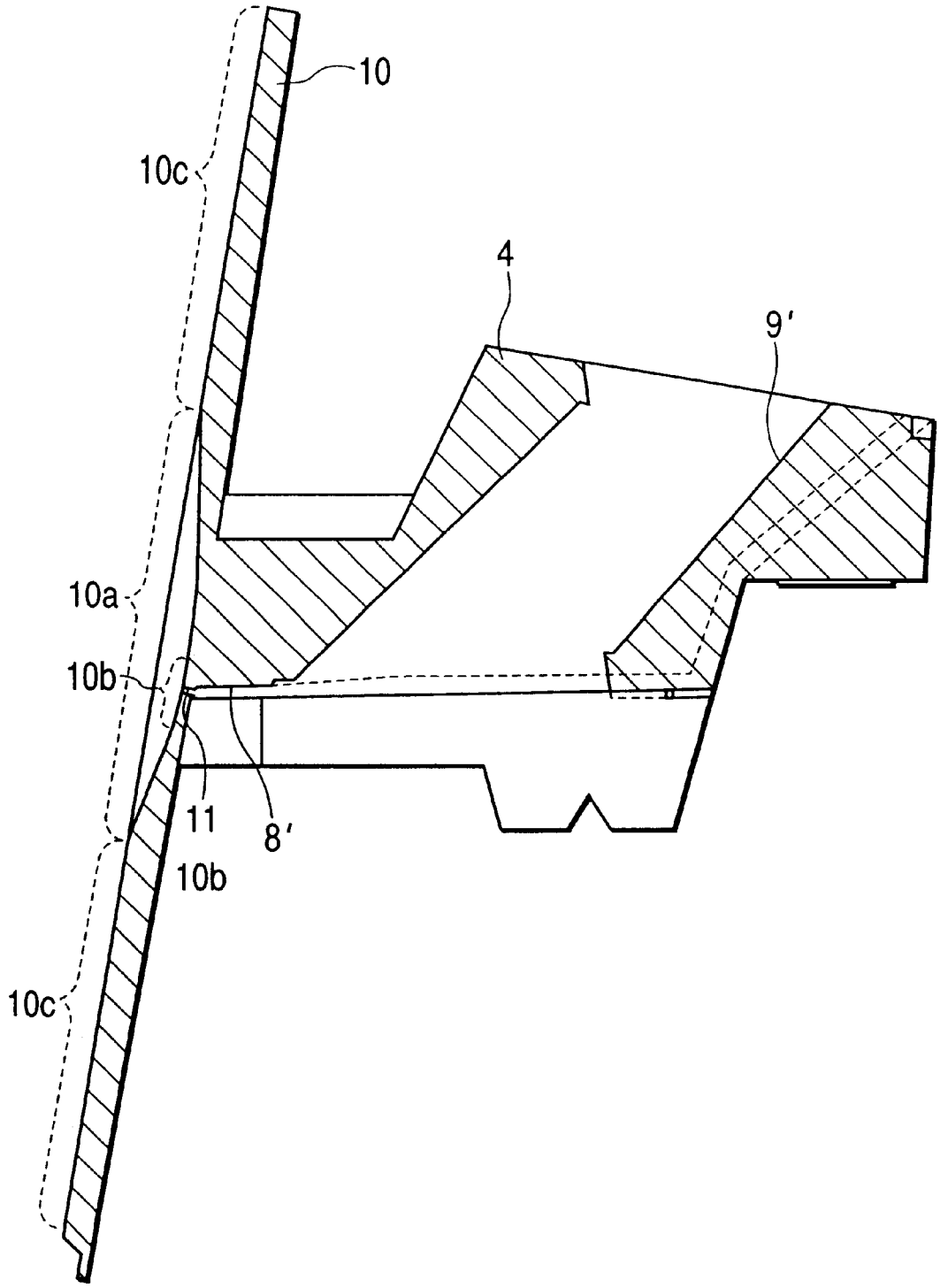
FIG. 5 is a sectional view of a grooved top plate of the head unit shown in FIG. 1.
Figure 6:
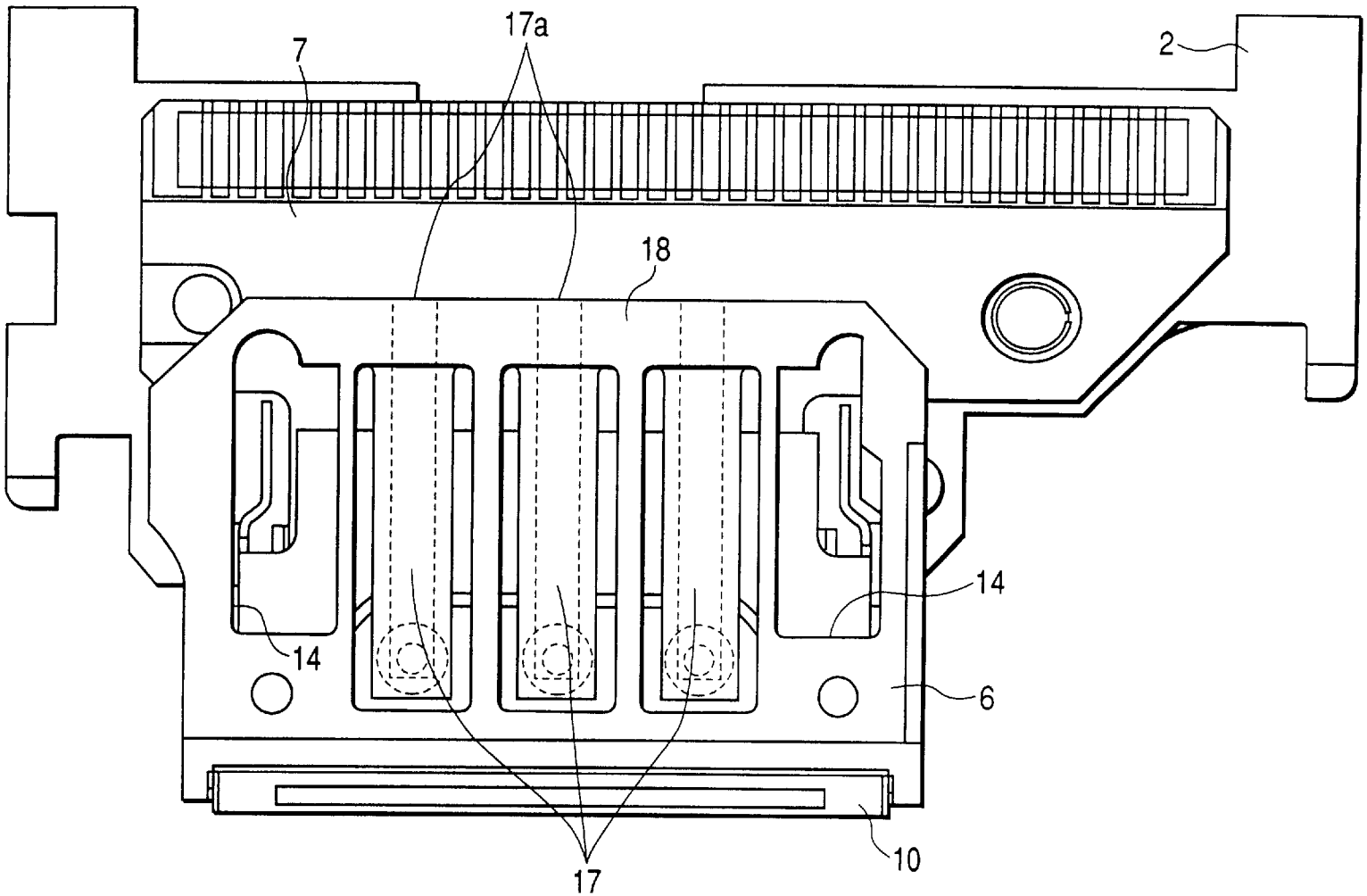
FIG. 6 is a top plan view of the head unit shown in FIG. 1.

In the embodiment shown in FIG. 5 or others, a recess surface 10*a* on which the plurality of orifices 11 are arranged is formed on the orifice plate 10 so as to obtain an appropriate length of nozzles which open as orifices. This recess surface 10*a* has the closest area 10*b* to the plurality of orifices. In this embodiment, the closest area 10*b* is substantially parallel to a peripheral area 10*c* of the recess surface 10*a* of the orifice plate 10 and is inclined to the element base.

Figure 10:
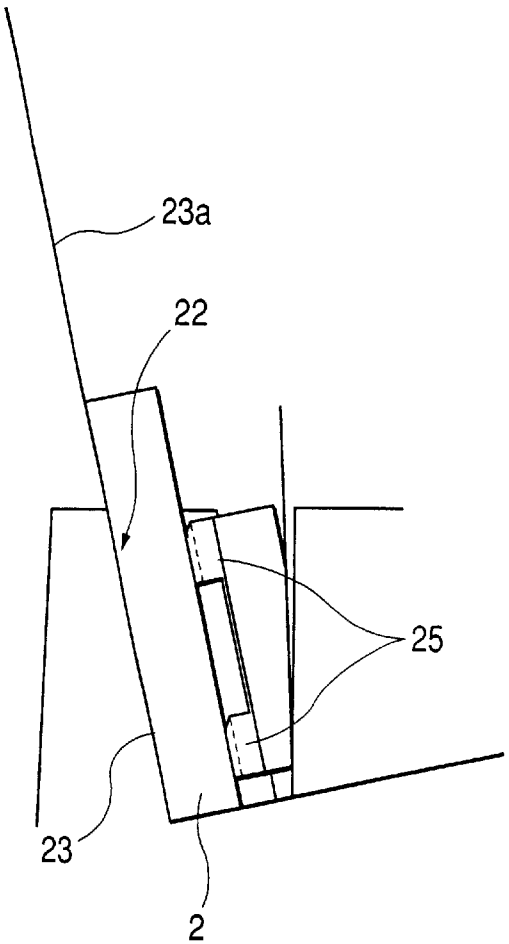
FIG. 10 is an expanded view of one head unit fixing portion.
Figure 9:
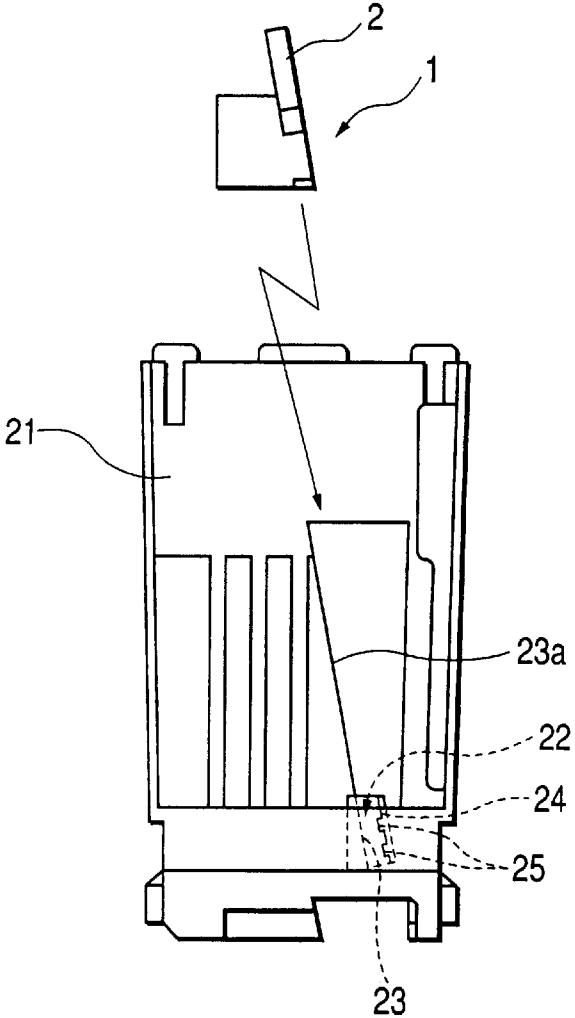
FIG. 9 is an explanatory diagram showing a method of connecting the head unit with a head unit retaining member according to the embodiment of the present invention.
Figure 11:
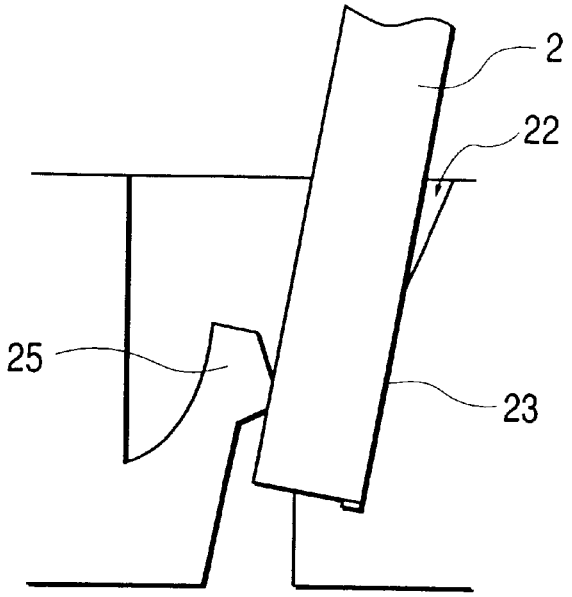
FIG. 11 is an expanded view of the other head unit fixing portion.

The head unit (ink jet recording head) 1 having the above constitution is retained by a head unit retaining member 21. As shown in FIG. 9, a head unit retaining member 21 is provided with an engaging groove portion 22 in which the head unit 1 can be retained by an insertion of the base plate 2. The engaging groove portion 22 is provided between a rail-like head unit positioning reference surface 23 protruding to the inner surface of the head unit retaining member 21 and its opposite surface 24, and a guide portion 23*a* is arranged continuously from the head unit positioning reference surface 23. Therefore, the head unit 1 is retained by the head unit retaining member 21 with sliding the base plate 2 along a guide portion 23*a* so as to move to the engaging groove portion 22. The guide portion 23*a* is arranged continuously from the head unit positioning reference surface 23, and therefore the guide portion 23*a* acts as an assistance of positioning the head unit 1. As shown in FIGS. 10 and 11, an elastic click portion 25 is arranged on an opposite surface 24 in order to contact the base plate 2 with pressure to the head unit positioning reference surface 23. Furthermore by coating the engaging groove portion 22 with adhesive and hardening it, the fixing strength is improved.

Figure 12:
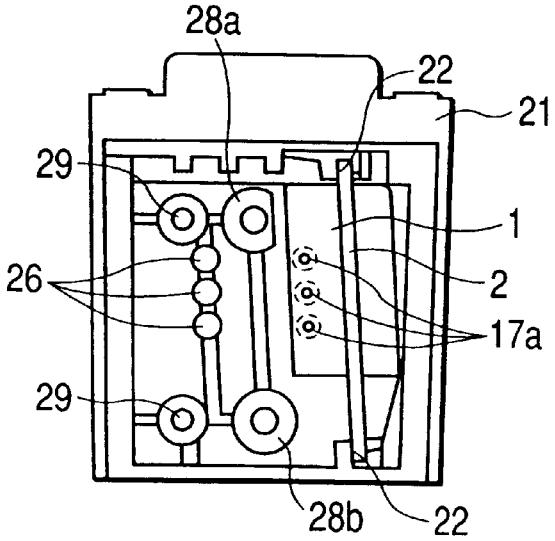
FIG. 12 is an inner face view of the head unit retaining member under a state of retaining the head unit.

FIG. 12 shows an inner surface of the head unit retaining member 21 under a state of retaining the head unit 1. In this inner surface, three joint pins 26 are arranged. These joint pins 26 are formed so as to have substantially the same height as for the inlets 17*a* of the head unit 1. The three inlets 17*a* are arranged so as to be opposite to the three joint pins 26 and so that they form two rows in parallel with each other.

In addition in the inner surface of the head unit retaining member 21, there are arranged cylindrical portions 28*a* and 28*b* into which fixing screws 27 (See FIGS. 16, 17, 18, and 22) can be penetratingly inserted; one cylindrical portion 28*a* is lower than the other cylindrical portion 28*b* so as not to interrupt an attachment of the head unit 1. Additionally, a mating pin 29 is arranged.

Figure 13:
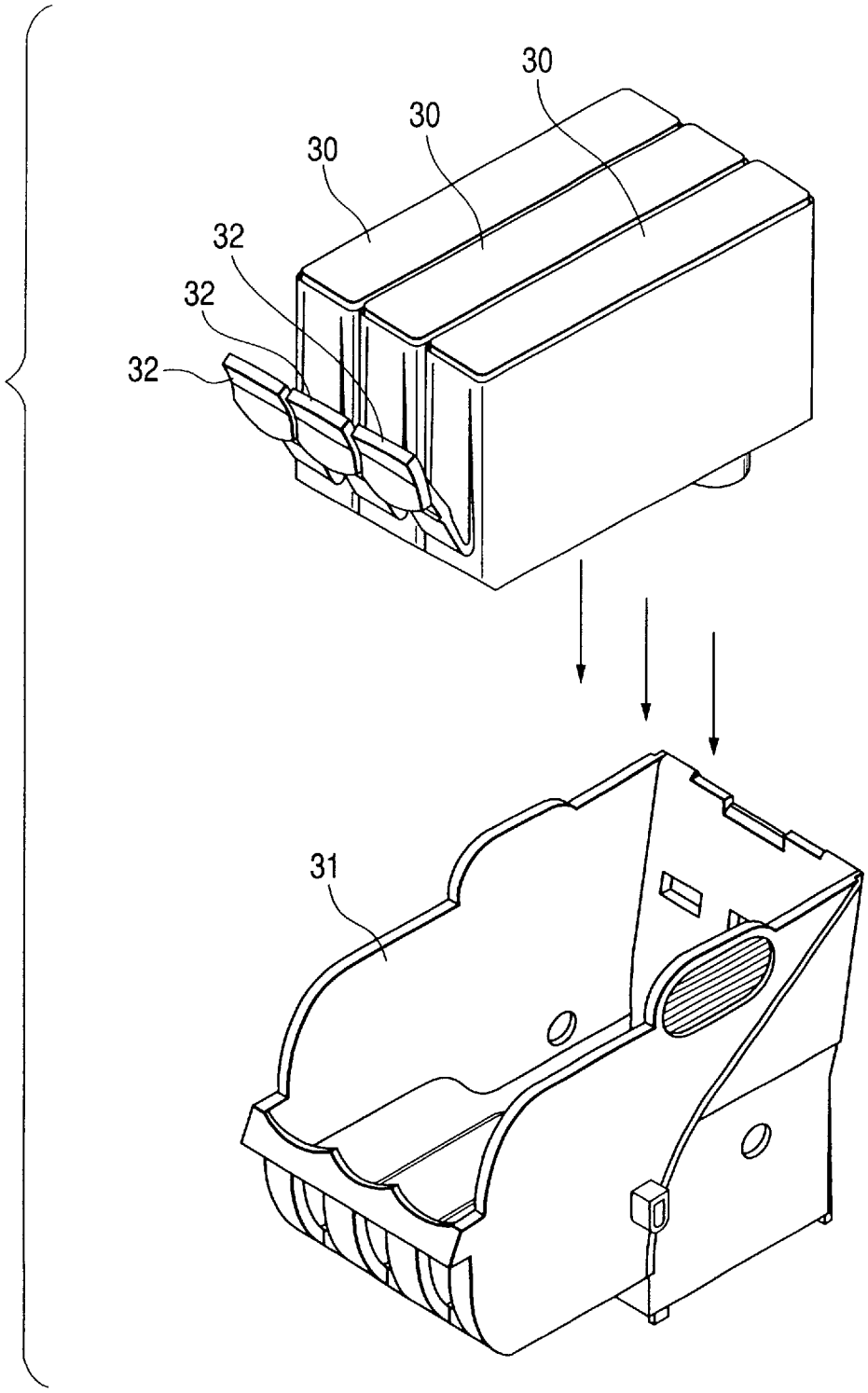
FIG. 13 is an explanatory diagram showing a method of connecting an ink tank with an ink tank retaining member according to the embodiment of the present invention.

Next, an ink tank 30 and an ink tank retaining member 31 shown in FIG. 13 are described below. Since color recording with three color inks is assumed in this embodiment, three ink tanks 30 having the same shape are used here. These three ink tanks 30 aligned and retained by the ink tank retaining member 31 are attached to the head unit retaining member 21 for retaining the head unit 1. Respective ink tanks 30 are detachable independently by an operation of respective levers 32.

Figure 14:
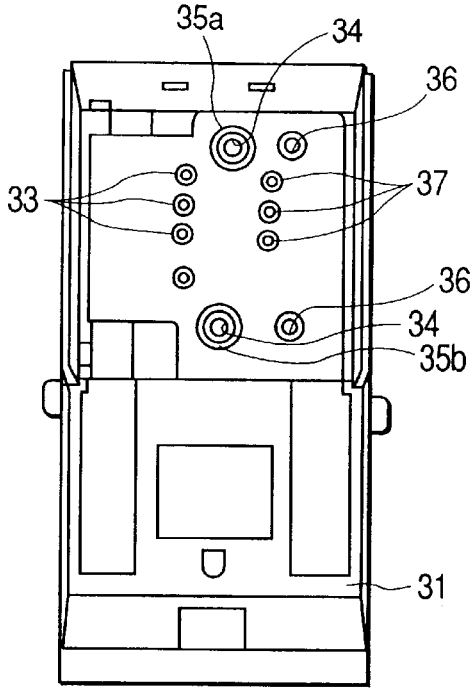
FIG. 14 is a bottom plan view of the ink tank retaining member.
Figure 15:
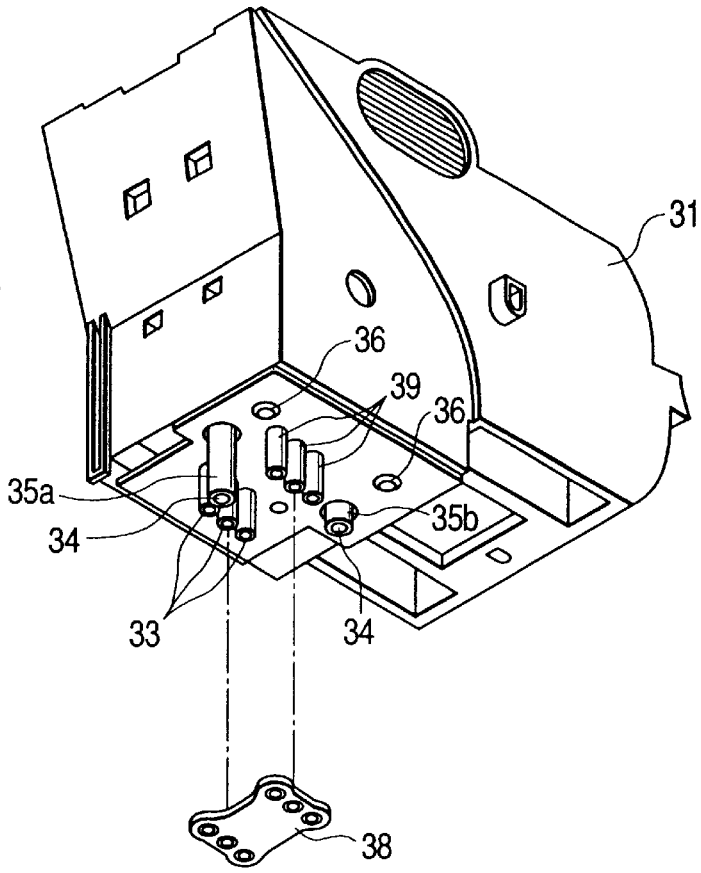
FIG. 15 is a perspective view of the ink tank retaining member.
Figure 16:
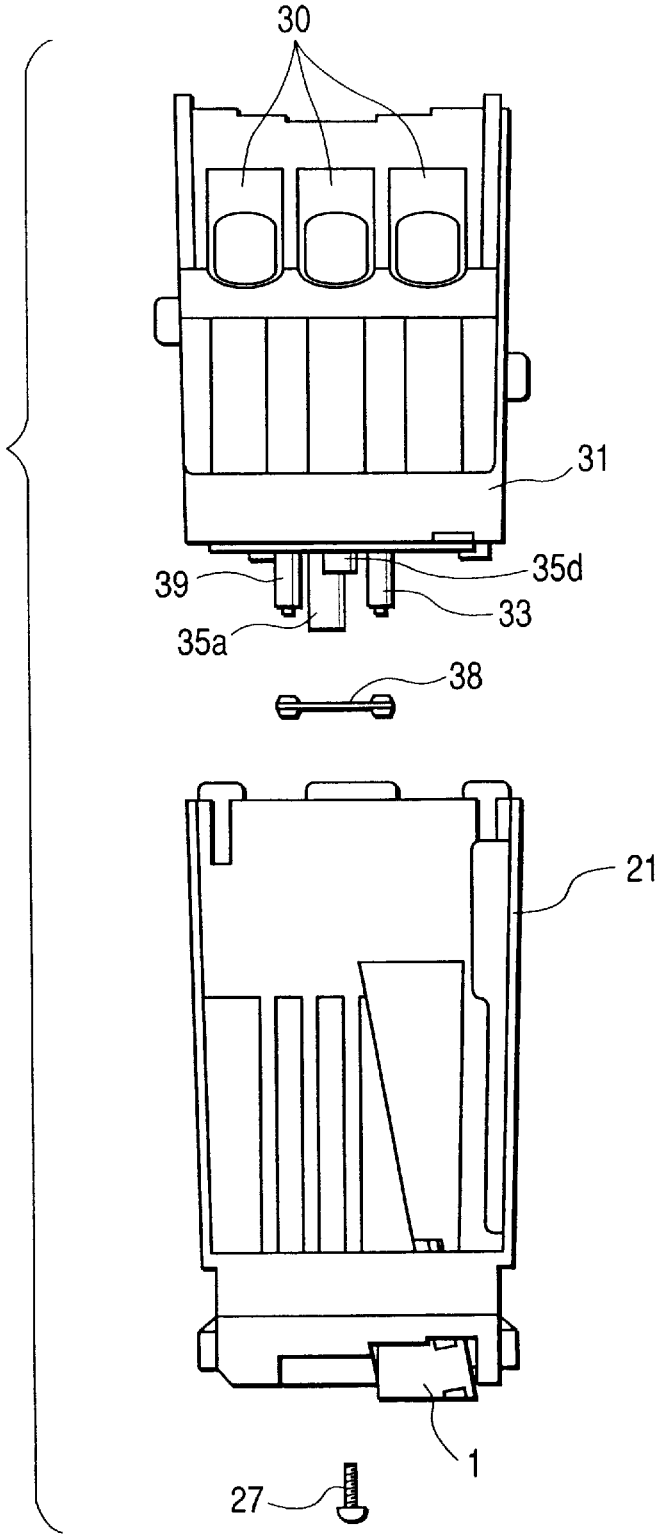
FIG. 16 is an explanatory front view showing a method of connecting the head unit retaining member with the ink tank retaining member according to the embodiment of the present invention.

The ink tank retaining member 31 has an external shape which allows to be mounted on the inside of the head unit retaining member 21. As shown in FIGS. 14 and 15, at the bottom of the ink tank retaining member 31, there are arranged three outlet tubes 33 each having communication with three ink tanks 30 so as to flow out inks, three joint pins 37 opposite to these outlet tubes 33 and forming one of two rows in parallel with each other, two cylindrical portions 35*a* and 35*b* having tapped holes 34 into which screws 27 (See FIGS. 16, 17, 18, and 22) are inserted, and two mating recess portions 36. Three outlet tubes 33 are opposite to three inlet tubes 17 of the head unit 1, three joint pins 37 are to three joint pins 26 of the head unit retaining member 21, two cylindrical portions 35*a* and 35*b* are to two cylindrical portions 28*a* and 28*b* of the head unit retaining member 21, and two mating recess portions 36 are opposite to two mating pins 29 of the head unit retaining member 21. All of the three outlet tubes 33 and the three joint pins have the same height.

Figure 18:
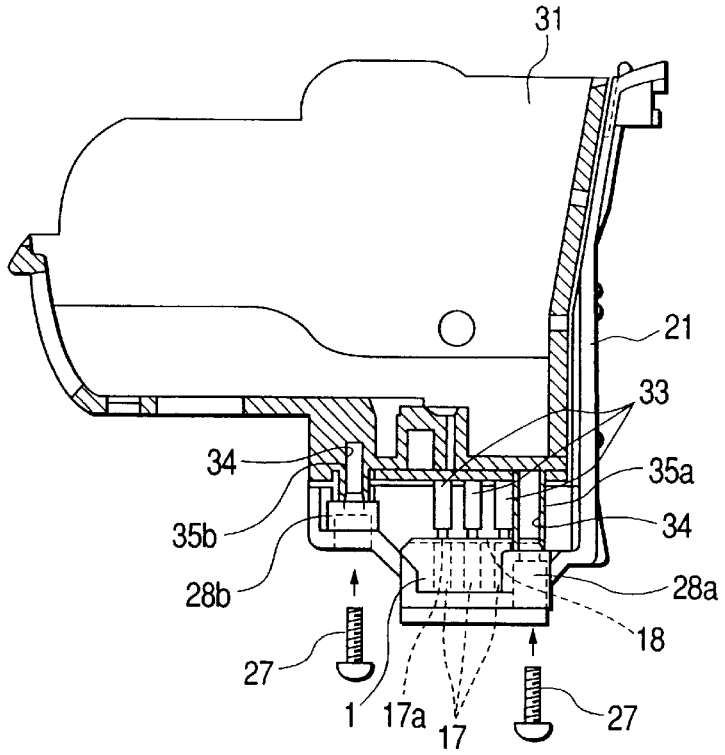
FIG. 18 is a partially sectional view of an ink jet recording cartridge according to the embodiment of the present invention.
Figure 19:
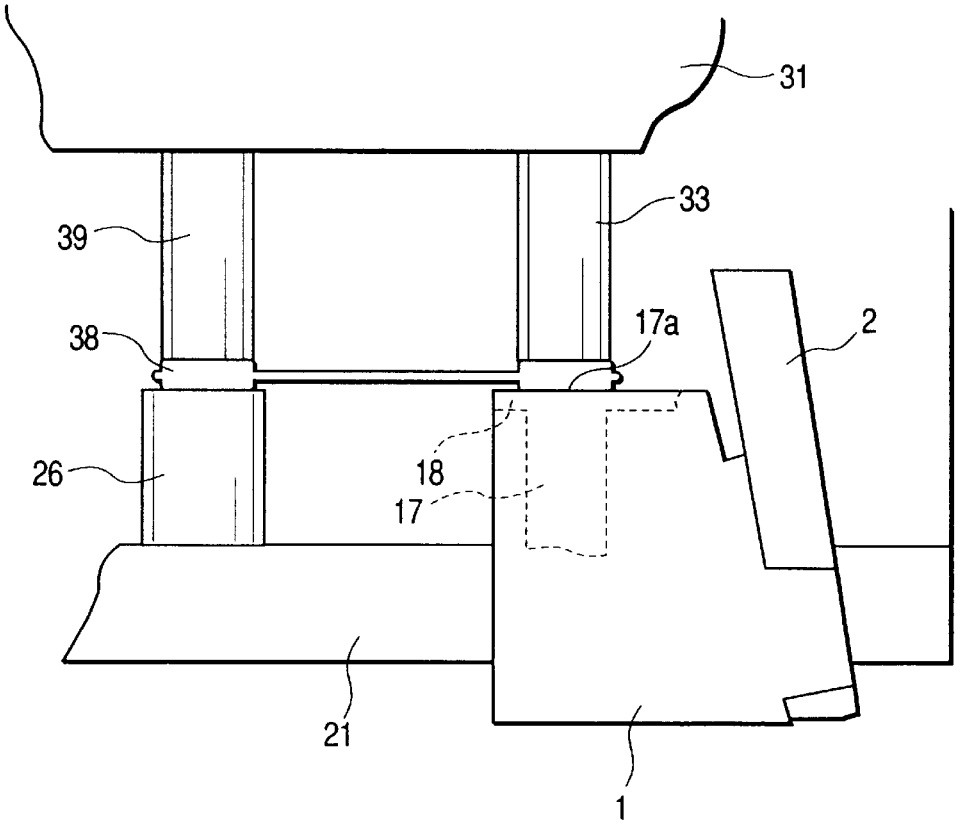
FIG. 19 is an expanded view of a connecting portion between the head unit retaining member and the ink tank retaining member.

Subsequently, with reference to FIGS. 16 to 19, a description is made for a joint structure between the ink tank retaining member 31 under a state of retaining the ink tanks 30 and the head unit retaining member 21 a state of retaining the head unit 1. As shown in FIGS. 18 and 19, the three outlet tubes 33 have the three inlets 17*a* via the elastic member 38 and the three joint pins 37 are opposite to the three joint pins 26 via the elastic member 38 so that the two mating recess portions 36 are mated with the two mating pins 29. The screws 27 penetratingly inserted into the two cylindrical portions 28*a* and 28*b* are screwed in the tapped holes 34 of the two cylindrical portions 35*a* and 35*b*, by which the head unit retaining member 21 is connected to the ink tank retaining member 31. Since one cylindrical portion 28*a* of the head unit retaining member 21 is lower than the other cylindrical portion 28*b* thereof, one cylindrical portion 35*a* of the ink tank retaining member 31 is higher than the other cylindrical portion 35*b* thereof, and therefore the total of the heights of the cylindrical portion 28*a* and the cylindrical portion 35*a* is substantially equal to the total of the heights of the cylindrical portion 28*b* and the cylindrical portion 35*b*.

Figure 20:
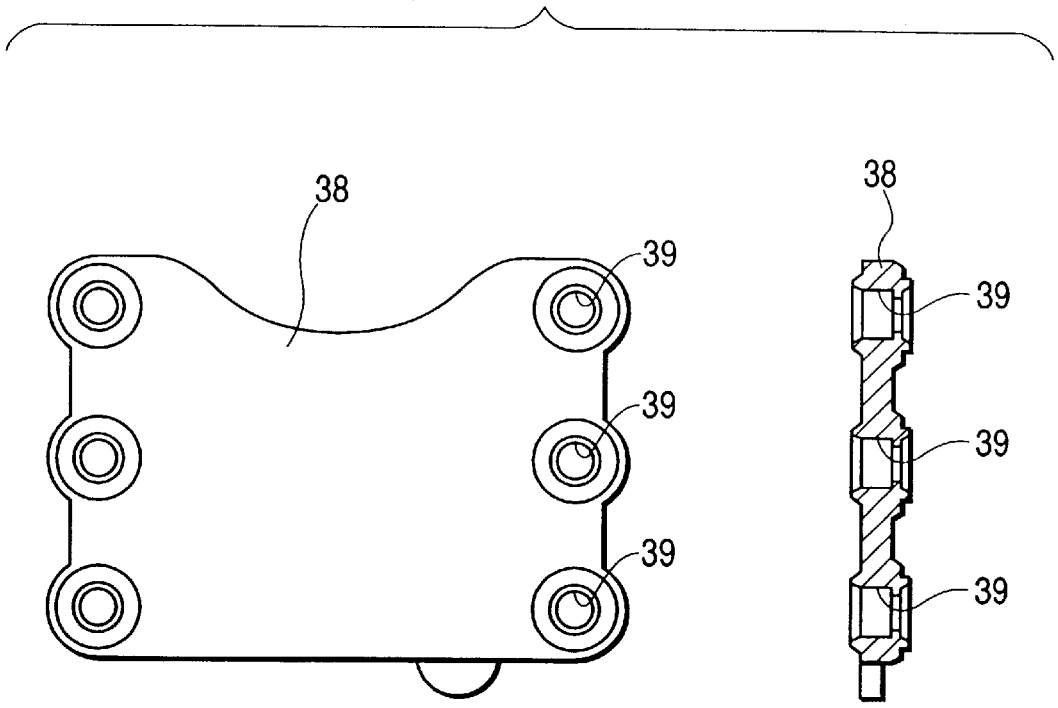
FIG. 20 is a plan view and a section view of an elastic member.

Referring to FIG. 20, there is shown an enlarged view of the elastic member. There are provided communication holes (hole portions) 39 in a portion between the outlet tubes 33 and the inlets 17*a*. There is no need, however, to arrange communication holes in a portion between the joint pins 37 and the joint pins 26. It is also possible to form joint pins 37 each having a pipe shape similar in shape to the outlet tubes 33 at a formation of the ink tank retaining member 31. In other words, the joint pins 37 are so-called dummy outlet tubes. In this case, be careful not to make any holes in portions of the elastic member 38 in contact with the joint pins 37 which are the dummy outlet tubes.

Figure 21:
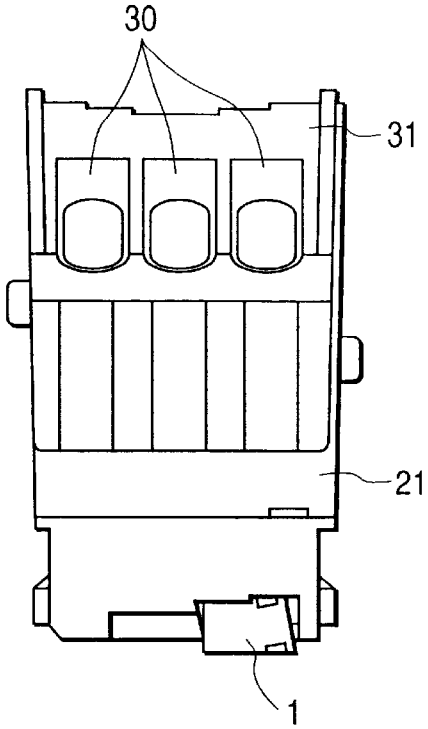
FIG. 21 is a rear elevation of the ink jet recording cartridge according to the embodiment of the present invention.

In the ink jet recording cartridge (See FIGS. 21 and 22) assembled as described above, inks are supplied from the ink tanks 30 to the orifices 11 sequentially through the outlet tubes 33, the communication holes 39 of the elastic member 38, the inlet tubes 17, and the ink flow channels 8. If the electrical heat converting elements which are the energy generating elements 42 are driven, heat energy is applied and it causes film boiling in the inks, by which the inks are discharged from the orifices 11 to the recording sheet 43 in the outside as its action.

Figure 22:
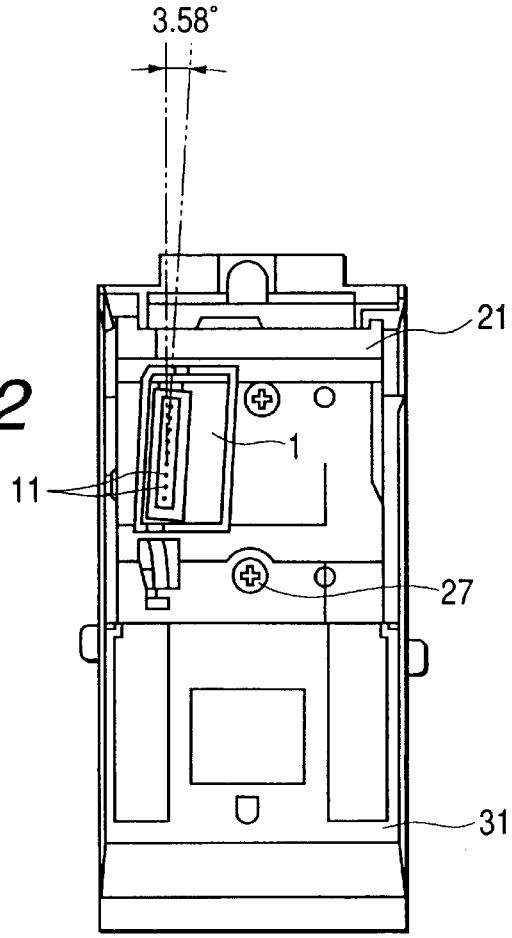
FIG. 22 is a bottom view of the ink jet recording cartridge shown in FIG. 21.
Figure 23:
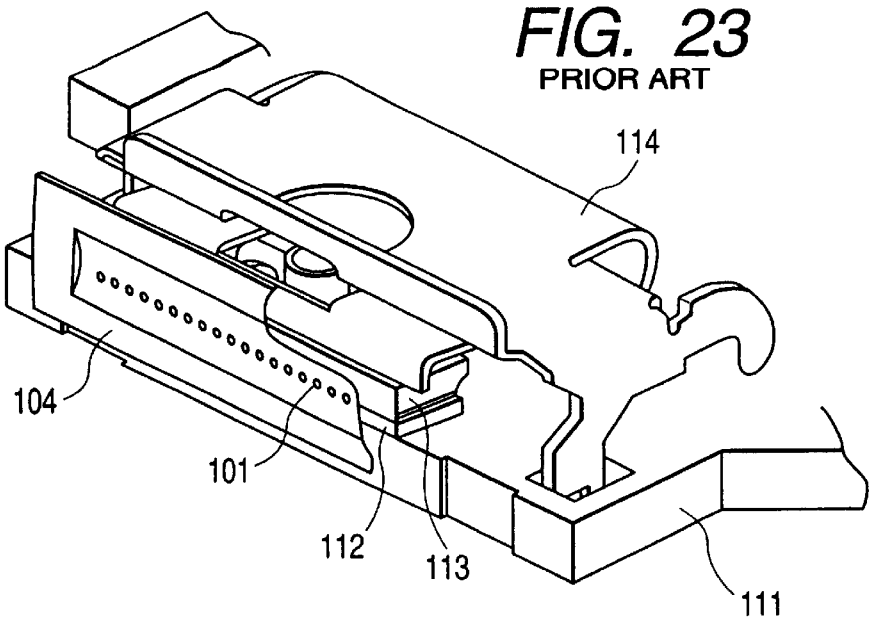
FIG. 23 PRIOR ART
FIG. 23 is a main portion perspective view of a conventional head unit.
Figure 24:
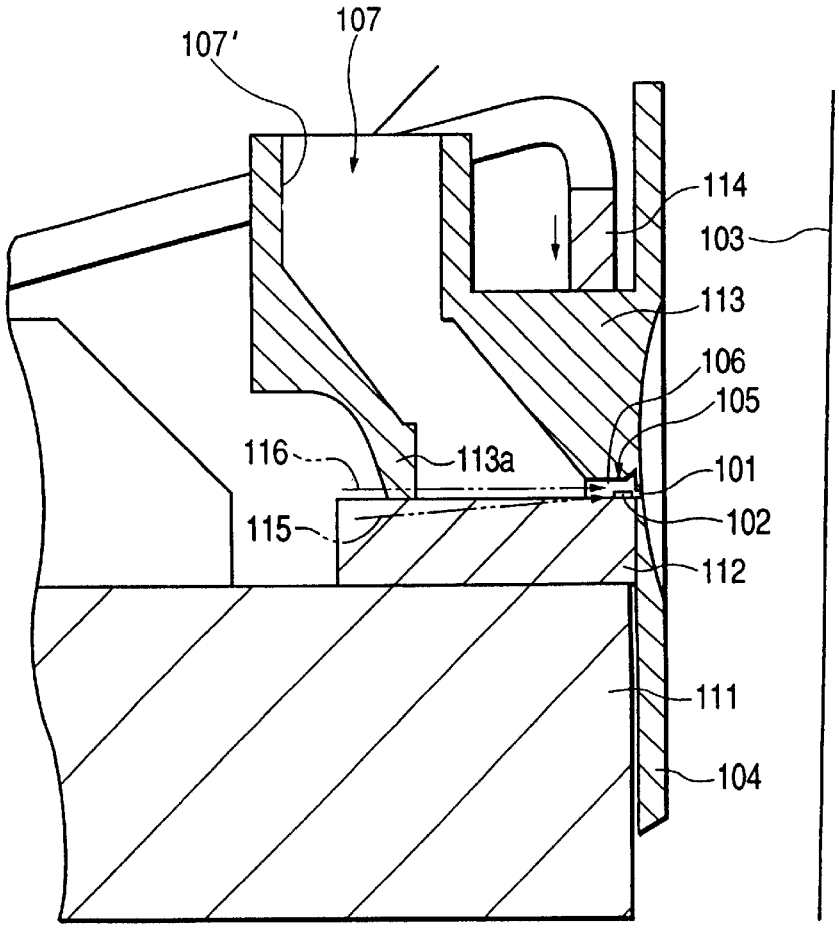
FIG. 24 PRIOR ART
FIG. 24 is a section view of the head unit shown in FIG. 23.

In the ink jet recording cartridge of this embodiment having the above constitution, the orifice plate 10 is arranged in parallel with a surface of the recording sheet 43 and a row of the orifices 11 is arranged being inclined at approx. 3.58 deg in a paper feeding direction of the recording sheet 43 by the recording sheet conveying means 44 as shown in FIG. 22. If the row of the orifices 11 is parallel to the paper feeding direction, all the orifices 11 have to be driven at a time when inks are discharged from all of the multiple orifices 11 vertically aligned in FIG. 22, and it is not preferable since it may cause an unstable ink fluid state in the common liquid chambers 9 and the ink flow channels 8, a lack of ink, or a problem of power consumption. Therefore, with the row of the orifices 11 inclined to the paper feeding direction as described in this embodiment, driving timings of the energy generating elements can be shifted so as to avoid the above problems even if inks are discharged from all of the orifices 11.

The head unit 1 is fixed to the head unit retaining member 21; its positional precision is important to obtain high-quality printed images and therefore it is better to minimize an external force which may shift the head unit 1 to an incorrect position. For example, if the ink tanks are directly attached to the head unit in a constitution in which the ink tanks are detachable, an impact at the attachment may affect significantly the positional precision and deteriorate it. The head unit retaining member having a size large enough to be endurable to the impact or a special mechanism arranged for cushioning is not preferable from the viewpoint of down-sizing or constitutional simplification. Accordingly in this embodiment, the ink tanks 30 are attached to the head unit retaining member 21 via the ink tank retaining member 31, by which an impact at the attachment is relieved so as to restrain the deterioration of the positional precision of the head unit 1.

The outlet tubes 33 of the ink tank retaining member 31 are put in contact with the inlets 17*a* of the head unit retaining member 21 with pressure via the elastic member 38. The elastic member 38 prevents an ink leakage at joints and relieves an impact to the head unit 1 at attachment or detachment of the ink tanks 30.

Additionally taking into consideration a balance of a load more or less applied from the ink tank retaining member 21 to the head unit 1 when the screws 27 are tightened, the joint pins 26 and 37 are disposed to be symmetrical relative to the outlet tubes 33 and the inlets 17*a* about a line between two tapped holes 34 so that the loading direction is parallel to the screwing direction. The positions of the tapped holes 34 are inclined at approx. 3.58 deg in correspondence with the head unit 1 attached being inclined at approx. 3.58 deg.

Although it is possible to apply welding or to use a locking mechanism instead of using the screws 27 or to fix the screws 27 with adhesive or silicone material as a fixing means between the head unit retaining member 21 and the ink tank retaining member 31, fixing only with the screws 27 as described in this embodiment has not only an advantage that easy attachment or detachment makes it easy to reuse the components or to appropriate the components to another unit expansion, but also an advantage that a constitution is simplified and it leads to a reduction of the cost.

The screwing work, however, involves unevenness and unstableness of a positional relationship between a flute on the head of the screw 27 and a screwdriver or the directions. Therefore, the screw fixing portion is put to a depth at which the head of the screw is slightly higher than the outermost surface when the screw is dropped into the tapped hole, by which the screw position after the drop-in is stabilized and the process becomes stable. Therefore, the cylindrical portions 35*a* and 35*b* of the ink tank retaining member 31 have a difference of the height, taking into consideration of the connection between the cylindrical portions 28*a* and 28*b* of the unit retaining member 21. In addition, the mating recess portions 36 and the mating pins 29 are disposed around the elastic member 38.

What is claimed is:

1. An ink jet recording head, comprising:

an element base having a plurality of energy generating elements for generating energy used for discharging ink;

a grooved top plate having a plurality of grooves corresponding to said plurality of energy generating elements, being joined to said element base, and having a plurality of ink flow channels formed by said plurality of grooves on a joint area side to said element base;

an orifice plate having a plurality of orifices having communication with said plurality of ink flow channels respectively and being mounted on said grooved top plate integrally; and a chip tank having a supply passage for supplying ink to said plurality of ink flow channels, wherein a surface in a side of said plurality of orifice of said orifice plate and an inner surface of said supply passage of said chip tank are substantially parallel with each other and are inclined and not perpendicular to a surface in a side of said plurality of energy generating elements of said element base.

2. An ink jet recording head according to claim 1, wherein there is arranged an inclined portion corresponding to said inclination of said orifice plate on a surface in a vicinity of said orifice plate on a base plate for fixing said element base.

3. An ink jet recording head according to claim 1, wherein a surface of said chip tank opposite to the mounting surface onto said grooved top plate is inclined relative to a direction of said ink flow channels.

4. An ink jet recording head according to claim 1, wherein said supply passage of said chip tank has an L-shaped form.

5. An ink jet recording head according to claim 1, wherein said grooved top plate is provided with a processing reference surface which is to be a reference for a formation of said orifices.

6. An ink jet recording head according to claim 5, wherein said orifices are formed by laser processing and said processing reference surface is used for fixing a jig for a laser irradiation at said laser processing.

7. An ink jet recording head according to claim 1, wherein said energy generating elements are electrical heat converting elements for generating heat energy.

8. An ink jet recording head according to claim 7, wherein inks are discharged from said orifices by utilizing film boiling caused in the inks by the heat energy applied by said electrical heat converting elements. base.

9. An ink jet recording head according to claim 1, wherein said orifice plate has a recess surface formed on an area in which said plurality of orifices are arranged, and wherein an area closest to said plurality of orifices among the surfaces in the side of said plurality of orifices of said orifice plate is substantially parallel with peripheral areas of said recess surface of said orifice plate and is inclined to said element base.

10. An ink jet recording head according to claim 9, wherein said energy generating elements are electrical heat converting elements for generating heat energy.

11. An ink jet recording head according to claim 10, wherein inks are discharged from said orifices by utilizing film boiling caused in the inks by the heat energy applied by said electrical heat converting elements.

12. A recording apparatus having an ink jet recording head according to claim 1 or 9 and a record medium conveying means for conveying a record medium arranged substantially perpendicularly to a discharge direction in which inks are discharged from the ink jet recording head.

13. An ink jet recording cartridge, comprising:

an ink jet recording head unit, including an element base having a plurality of energy generating elements for generating energy used for discharging ink;

a base plate for fixing the element base; and a grooved top plate having a plurality of grooves corresponding to said plurality of energy generating elements respectively, being joined to said element base, and having a plurality of ink flow channels formed by said plurality of grooves on a joint area side to said element base; and a head unit retaining member, including an engaging groove portion where the ink jet recording head unit can be retained with said base plate inserted; and a guide portion for guiding said ink jet recording head unit to said engaging groove portion by sliding said base plate.

14. An ink jet recording cartridge according to claim 13, wherein said engaging groove portion is arranged between a head unit positioning reference surface and an opposite surface opposite to the head unit positioning reference surface and wherein said guide portion is continuously arranged from said head unit positioning reference surface.

15. An ink jet recording cartridge according to claim 14, wherein said head unit retaining member is arranged at least in one of said head unit positioning reference surface and said opposite surface and has an elastic click portion for catching said base plate inserted in said engaging groove portion.

16. An ink jet recording cartridge, comprising:

an ink jet recording head unit for discharging ink;

a head unit retaining member for retaining the ink jet recording head unit; and an ink tank retaining member for retaining an ink tank for containing ink, wherein said ink jet recording head unit is provided with an inlet to which ink is supplied, said ink tank retaining member is provided with an outlet tube for flowing out the ink connected to said ink tank, and said inlet is connected to said outlet tube so as to enable the ink to flow;

wherein said head unit retaining member is connected to said ink tank retaining member; and wherein said head unit retaining member and said ink tank retaining member are provided with joint pins opposite to each other respectively and wherein said inlets, said outlet tubes, and said joint pins are aligned in a plurality of rows.

17. An ink jet recording cartridge according to claim 16, wherein said joint pins of said head unit retaining member have substantially a same height as for said inlets of said ink jet recording head unit in a state that said ink jet recording head unit is retained by said head unit retaining member and wherein said joint pins of said ink tank retaining member have substantially a same height as for said outlet tubes.

18. An ink jet recording cartridge according to claim 16, further comprising an elastic member arranged between said inlets and said outlet tubes and having hole portions for communication of said inlets with said outlet tubes.

19. An ink jet recording cartridge according to claim 16., wherein said head unit retaining member is joined to said ink tank retaining member by screws.

20. An ink jet recording cartridge according to claim 16, wherein said plurality of rows formed by said inlets, said outlet tubes, and said joint pins are parallel to each other.

21. An ink jet recording cartridge according to claim 13 or 16, wherein said ink jet recording head unit discharges inks from said orifices by utilizing film boiling caused in the inks by heat energy applied by electrical heat converting elements.

22. A recording apparatus, comprising:

an ink jet recording cartridge according to claim 13 or 16; and a record medium conveying means for conveying a record medium arranged substantially perpendicularly to a discharge direction of ink discharged from said ink jet recording head unit.

* * * * *

UNITED STATES PATENT AND TRADEMARK OFFICE

CERTIFICATE OF CORRECTION

PATENT NO. : 6,416,155 B1
DATED : July 9, 2002
INVENTOR(S) : Takahashi et al.

It is certified that error appears in the above-identified patent and that said Letters Patent is hereby corrected as shown below:

Column 2,
Line 17, "a" should be deleted; and
Line 21, "accumulated" should read -- accumulate. --.

Column 4,
Line 30, "invention." should read -- invention; --.

Column 5,
Line 23, "plate 6," should read -- plate 2, --.

Column 6,
Line 32, "is" should read -- are --; and
Line 51, "stabilizes" should read -- stabilize --.

Column 7,
Line 51, "Furthermore" should read -- Furthermore, --.

Column 10,
Line 31, "orifice" should read -- orifices --; and
Line 62, "base." should be deleted.

Signed and Sealed this

Eighth Day of April, 2003

JAMES E. ROGAN
*Director of the United States Patent and Trademark Office*